US005685092A

United States Patent [19]

Prieskorn

[11] Patent Number: 5,685,092

[45] Date of Patent: Nov. 11, 1997

[54] PHYSIOLOGICAL MOTION ENHANCING SHOE SOLE

[76] Inventor: David W. Prieskorn, 10446 Summit View, Brighton, Mich. 48116

[21] Appl. No.: 603,244

[22] Filed: Feb. 20, 1996

[51] Int. Cl.[6] ..... A43B 13/40; A43B 13/38

[52] U.S. Cl. ..... 36/93; 36/43; 36/44

[58] Field of Search ..... 36/88, 93, 30 R, 36/30 A, 44, 80, 140, 142, 143, 144, 145, 154, 166, 169, 173, 174, 178, 180, 181, 43

[56] References Cited

U.S. PATENT DOCUMENTS

| | | | |
|---|---|---|---|
| 2,097,476 | 11/1937 | Silver | 36/37 |
| 2,599,317 | 6/1952 | Brady | 36/44 |
| 3,825,017 | 7/1974 | Scrima | 36/44 |
| 3,834,047 | 9/1974 | Schenker | 36/37 |
| 4,268,980 | 5/1981 | Gudas | 36/43 |
| 4,305,212 | 12/1981 | Coomer | 36/80 |
| 4,586,273 | 5/1986 | Chapnick | 36/44 |
| 4,694,589 | 9/1987 | Sullivan et al. | 36/44 |
| 5,224,810 | 7/1993 | Pitkin | 36/30 R |
| 5,282,326 | 2/1994 | Schroer, Jr. et al. | 36/44 |
| 5,463,824 | 11/1995 | Barna | 36/44 |

*Primary Examiner*—Paul T. Sewell
*Assistant Examiner*—Anthony Stashick
*Attorney, Agent, or Firm*—Young & Basile, P.C.

[57] ABSTRACT

A shoe sole having upper and lower layers movable relative to one another in a manner which promotes physiologically desirable movements of the subtalar joint of a shoe wearer's foot and thereby aids in the absorption of shock forces occurring when the shoe strikes the ground during a walking or running stride. The lower layer has an upper surface inclined downward and toward the lateral side of the sole, and a resilient intermediate layer separates the upper and lower layers. Application of weight to the hindfoot section of the upper layer at heel strike forces that section downward and laterally relative to the lower layer, placing the lateral edge of the upper layer in close proximity with a vertically oriented fulcrum formed in an upturned lip on the lateral side of the lower layer. Transfer of weight to the forefoot as the running or walking stride continues causes the forefoot section of the upper layer to move downward and laterally, and the upper layer simultaneously rotates about its point of contact with the fulcrum to return the hindfoot region to its original position. The inward rotation of the foot as the as the hindfoot section moves laterally also encourages the screw home function of the knee to improve its stability and injury resistance.

23 Claims, 4 Drawing Sheets

PHYSIOLOGICAL MOTION ENHANCING SHOE SOLE

FIELD OF THE INVENTION

The present invention relates to shoe soles and more particularly to a sole designed to encourage desirable physiologic motion of a shoe wearer's foot during a walking or running stride.

BACKGROUND OF THE INVENTION

During a normal walking or running stride, an average person's heel shifts toward the outside or lateral side of the foot immediately after it first contacts the ground. This lateral movement, known as eversion, serves to absorb or dissipate a portion of the shock loading applied to the foot as it strikes the ground. As the walking or running stride continues and the person's bodyweight is transferred forward to the midfoot and forefoot regions, the heel then shifts back toward the inside or medial side of the foot in a motion known as inversion. This sequence of movements is due to the action of the subtalar joint of the foot, which connects the calcaneus bone (heel bone) to the talus bone above it, and is the desirable, physiologically correct motion of a healthy foot.

Various physical conditions may have the effect of limiting or restraining the normal motion of the subtalar joint, among these being tarsal coalitions, arthridites of the hindfoot, and post-traumatic hindfoot conditions. If the natural movement of the subtalar joint is limited, the shock energy that normally would be absorbed by the joint is transferred to other joints in the foot, ankle, and knee, with possible harmful effects.

The shock loadings applied to the various bones and soft tissues of the lower limbs during walking or running may also have harmful effects. Conventional shoes, particularly those intended for use in athletics, often provide one or more layers of some type of shock absorbing material, but such materials lose a portion of their resiliency each time weight is applied during a running or walking stride. Some materials lose 0% to 80% of their shock absorption capacity after 500 miles of use. Thus, shoes must be discarded and replaced at frequent intervals in order to maintain an adequate level of protection from shock-produced injuries, at significant financial cost. It would thus be desirable to provide an athletic shoe having shock absorption characteristics that do not rely primarily on the compression of a resilient material.

The human knee is very susceptible to injury during athletic activities, a problem that has not been successfully dealt with by the availability of many different prophylactic knee braces intended to be worn while participating in sports. A normal, properly functioning knee has a naturally-occurring stabilizing mechanism, known as the "screw home" function, which makes it more able to withstand stresses such as those that are generated during running. The screw home function is caused by the tibia rotating outwardly, and in a normal walking or running stride this occurs only when the leg is fully extended at the end of each stride, as the person is pushing off of the toes. If an outward rotation of the tibia can be induced earlier in the stride, the knee will be stabilized by the screw home function during a greater portion of the stride, with resulting improvements in resistance of the knee to injury.

When a runner changes directions, it is usually accomplished by planting and pushing off of the foot and leg located away from the direction of the turn being made. For example, to make a turn to the right the runner pushes off of the left foot. As the runner's body begins to move in the direction of the turn, the leg being pushed off of is subjected to a twisting moment toward the inside of the runner's body. This applies stresses to the knee ligaments that can cause pain or injury. These twisting stresses may be lessened by allowed the planted foot to rotate in a toe-inward direction.

SUMMARY OF THE INVENTION

This invention is directed to the provision of a shoe sole which promotes physiologically desirable movements of a shoe wearer's foot during walking or running, with such movements aiding in the absorption of shock forces occurring when the shoe initially strikes the ground and encouraging the screw home function of the knee.

The invention sole comprises an upper layer and a lower layer movable relative to one another in both vertical and horizontal directions.

According to a feature of the invention, the lower layer has an upper surface that is inclined downwardly and toward the lateral side over a substantial portion of its hindfoot section such that the application of a downward force to the hindfoot section of the upper layer causes it to move downward and laterally relative to the lower layer. The resulting lateral motion of the heel serves to simulate proper functioning of the subtalar joint in those shoe wearers having an injured or otherwise malfunctioning joint, and to augment the functioning of the subtalar joint in those with a normal, healthy joint. By permitting movement of the heel in the lateral direction, the invention sole also acts to decrease the twisting forces applied to a runner's knee when he or she pushes off of the outside leg to effect a change of direction.

According to another feature of the invention, the lower layer further includes a fulcrum positioned at the lateral side of the midfoot section so as to be placed in physical interference with the lateral side of the upper layer when the upper layer hindfoot section moves in the lateral direction. The interference between the fulcrum and the upper layer restrains the upper layer forefoot section against lateral movement when the hindfoot section is weighted, so that a slight toe-inward rotation of the foot occurs.

According to another feature of the invention, the forefoot section of the lower layer also is inclined downwardly and toward the lateral side over a portion of its upper surface. The lateral movement of the hindfoot section of the upper layer when it is weighted places the lateral edge of the upper layer in physical interference with the fulcrum, and the shift of the runner's weight to the forefoot as the stride progresses causes a downward and lateral movement of the forefoot section of the upper layer relative to the lower layer. The downward and lateral movement of the forefoot section causes the upper layer to rotate in a substantially horizontal plane about its point of contact with the fulcrum such that the hindfoot portion of the upper layer moves upward and medially with respect to the lower layer, thereby returning to its original unweighted position. This slight toe-outward rotation of the foot induces the screw home function of the knee.

According to a further feature of the invention, the fulcrum is located at a position approximately coincident with the calcaneal-cuboid joint of the shoe wearer's foot. This position for the pivot is believed to be optimum in terms of causing the toe-outward rotation of the upper layer at the appropriate time during the stride.

According to yet another feature of the invention, the sole further comprises an intermediate layer disposed between the upper layer and the lower layer and formed of a resilient material. The intermediate layer is in an undeformed condition when no downward force is applied to the shoe sole and is movable to a deformed condition by the downward and lateral movement of the hindfoot section of the upper layer. The resiliency of the intermediate layer serves to maintain the upper and lower layers in their proper relative positions until weight is applied, and also provides a measure of impact absorption.

According to a further feature of the present invention, the intermediate layer is formed of material having a non-uniform density, and is preferably generally more dense toward its medial side than toward its lateral side in order to promote the lateral movement of the upper layer hindfoot section when weight is applied thereto.

According to a feature of an alternative embodiment of the present invention, the upper layer has a lower surface inclined downwardly and toward the lateral side over a substantial portion of its hindfoot section, roughly matching the inclination of the lower layer. This configuration is in lieu of the provision of an intermediate layer as in the first described embodiment, and acts to maintain the upper layer hindfoot section in an approximately horizontal orientation while it undergoes its lateral shift.

These and other features and advantages of the present invention are made clear in the detailed description to follow.

BRIEF DESCRIPTION ON THE DRAWINGS

DETAILED DESCRIPTION OF THE PREFERRED EMBODIMENT

Figure 1:
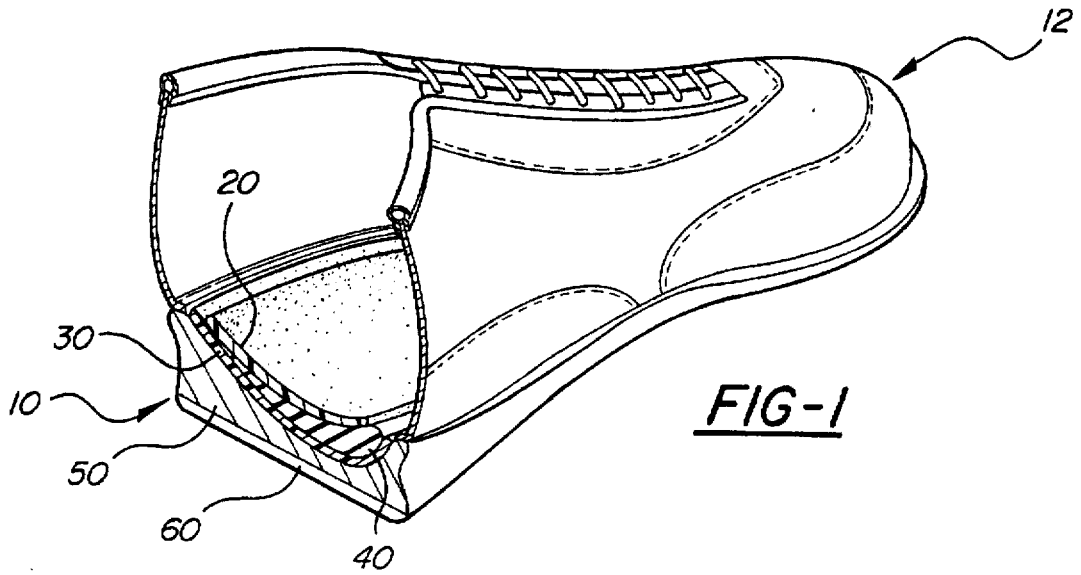
FIG. 1 is a rear-quarter perspective view of a shoe with a portion of the heel cut away to show the invention sole.

As seen in FIG. 1, the invention shoe sole 10 is intended to be integrated with an otherwise conventionally known shoe 12. The depicted sole 10 is for the right foot of a wearer, and it should be understood that the following description also applies to a shoe sole for the left foot. Note that the term "lateral" as used herein refers to the side of either foot which is toward the outside of the human body, and the term "medial" refers to that side of either foot which is adjacent to the center of the human body. Thus, the lateral side of the right foot is located on the right and the medial side is located on the left, while for the left foot the lateral side is located on the left and the medial side is located on the right.

It should also be noted that although the following description refers to the functioning of the sole when used in running, it is to be understood that the present invention is also suitable for use in walking or any other form of bipedal locomotion.

Sole 10 comprises an upper layer 20, a lower layer 30, an intermediate layer 40, a support layer 50, and a base layer 60. Upper layer 20 is formed from a substantially rigid material, preferably a thermoplastic such as polyvinyl chloride, and is preferably of substantially uniform thickness. As may best be seen in FIG. 2, upper layer 20 is comprised of a posterior hindfoot section 22, a central midfoot section 24, and an anterior forefoot section 26. If desired, upper layer 20 may be contoured to provide an arch support in midfoot section 24, and/or a somewhat concave heel cup in hindfoot section 22.

Lower layer 30 is formed from a material having properties similar to those of upper layer 20, and also is preferably of substantially uniform thickness. Again referring to FIG. 2, lower layer 30 is seen to comprise a deeply concave hindfoot section 32, a midfoot section 34, and a forefoot section 36, with a steeply angled, upturned lip 37 running along the lateral side of the hindfoot and midfoot sections. Support layer 50 is formed from a high-density foam such as that used in conventionally known athletic shoes and underlies lower layer 30 so that the lower layer's upper surface slopes downward and to the lateral side over substantially the entire area of sole 10. It is not strictly necessary for lower layer 30 and support layer 50 to be formed separately, but rather the layers may both be formed from the same material.

Lower layer 30 is slightly wider than upper layer 20 over substantially the entire length of sole 10, and defines a fulcrum 38 in lip 37 of midfoot section 34. Fulcrum 38 is in the form of a slight inward bulge in lip 37 protruding toward the medial side of the sole and defines a vertically oriented pivot axis, as is best seen in FIGS. 3A–3C.

Intermediate layer 40 is formed from a resilient, compressible material such as ethylene vinyl acetate, polyurethane silicone-gel cellophane, or a sealed air bladder and is interposed between upper and lower layers 20, 30 over substantially all of the hindfoot and midfoot sections. Intermediate layer 40 is molded to a shape such that when it is undeformed it fills the space between the upper and lower layers when they are positioned relative to one another as in the unweighted condition described below.

Figure 3A:
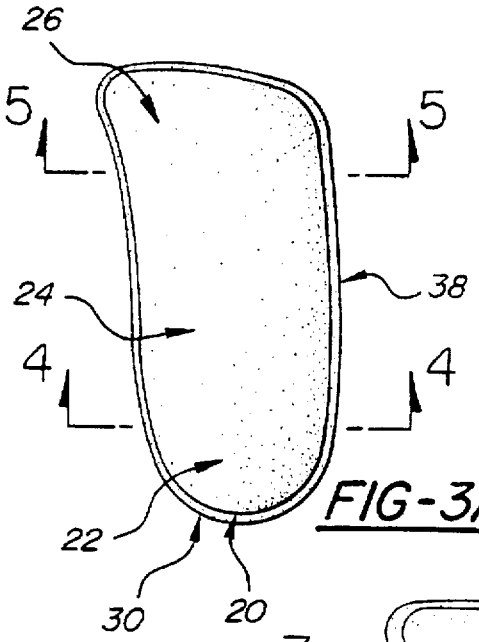
FIG. 3A is a plan view of the upper and lower layers as they are positioned relative to one another when no weight is applied to the sole.
Figure 3B:
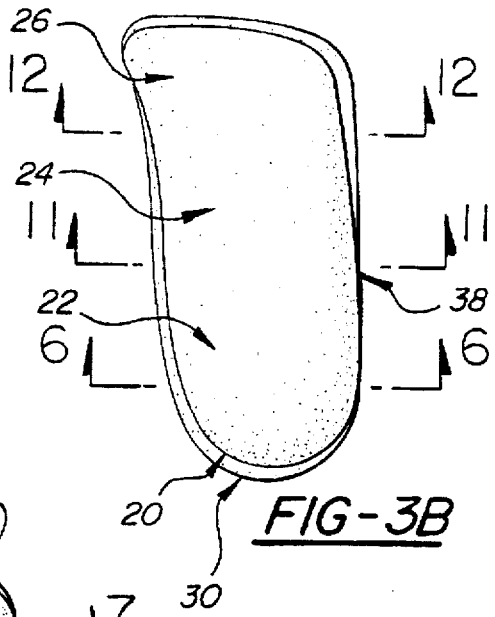
FIG. 3B is a plan view of the upper and lower layers as they are positioned relative to one another when weight is applied to the posterior region of the sole.
Figure 3C:
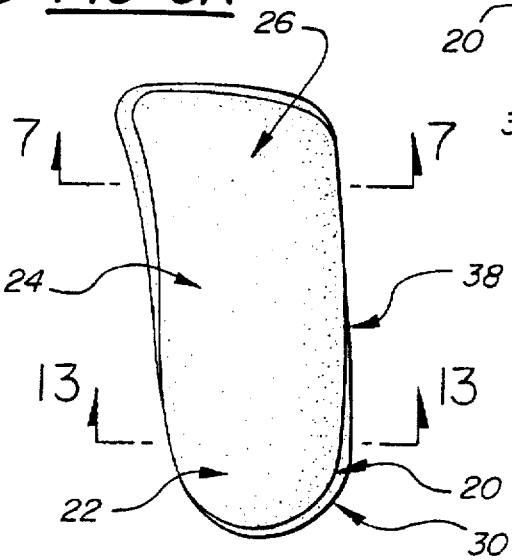
FIG. 3C is a plan view of the upper and lower layers as they are positioned relative to one another when weight is applied to the anterior region of the sole.

When sole 10 has no weight applied to it, as is the condition prior to shoe 12 contacting the ground during a running stride, upper and lower layers 20, 30 are positioned relative to one another as shown in FIG. 3A, with the upper layer offset toward the medial side of the lower layer. When the upper and lower layers are thus positioned, intermediate layer 40 is undeformed and its elasticity acts to maintain the upper and lower layers in their unweighted positions.

Figure 6:
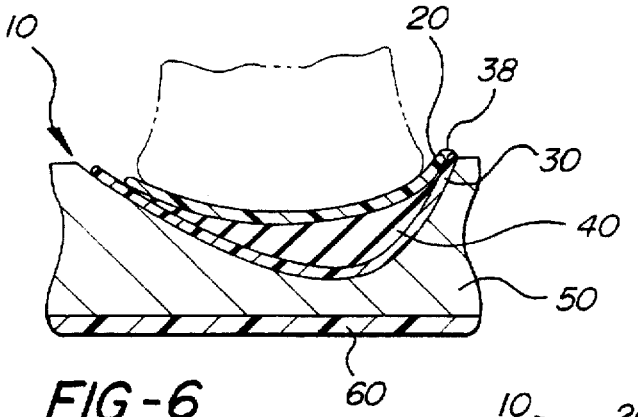
FIG. 6 is a cross-sectional view of the sole of FIG. 1 taken along line 6—6 of FIG. 3B.
Figure 11:
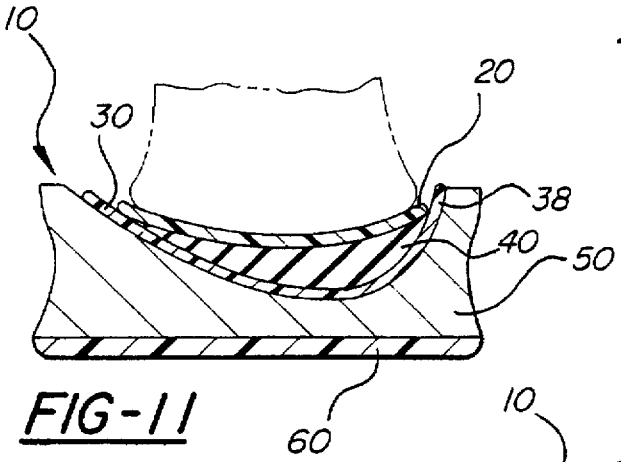
FIG. 11 is a cross-sectional view of the sole of FIG. 1 taken along line 11—11 of FIG. 3B.

As shoe 12 strikes the ground, the wearer's body weight is applied first to the upper layer hindfoot section 22 via the runner's calcaneus bone or heel 70. This application of force to upper layer hindfoot section 22 causes it to move downward as intermediate layer 40 compresses and deforms, and to simultaneously shift toward the lateral side of lower layer 30 due to the downward and lateral slope of the lower layer. This lateral shift brings the upper and lower layers into the positions shown in FIGS. 3B and 6, with the lateral sides of upper layer hind midfoot section 22 and upper layer midfoot section 24 in close proximity to lip 37 and in physical interference with fulcrum 38 (see FIG. 11). This physical interference may take the form of either direct contact between the upper layer and the fulcrum, or indirect contact wherein a portion of intermediate layer 40 is pinched or compressed between the two components.

As upper layer hindfoot section 22 shifts in the lateral direction, the runner's heel 70 moves laterally also. This movement of heel 70 enhances the normal functioning of the subtalar joint 72 or, in the case of individuals whose subtalar joints do not function properly due to foot injuries or ailments, serves to simulate normal subtalar joint function.

By permitting movement of the heel in the lateral direction, the invention sole also acts to somewhat relieve the twisting stresses applied to a runner's knee when he or she pushes off of the outside leg to effect a change of direction.

Figure 5:
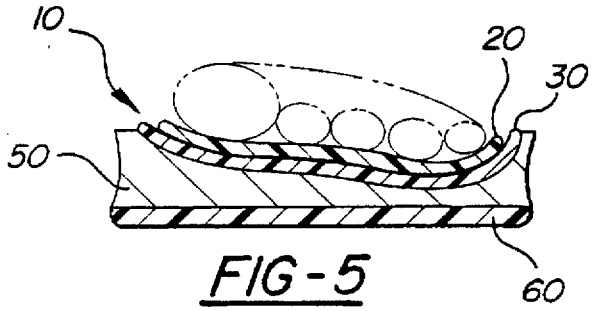
FIG. 5 is a cross-sectional view of the sole of FIG. 1 taken along line 5—5 of FIG. 3A.

Due to the physical interference between the lateral side of upper layer midfoot section 24 and fulcrum 38, the unweighted upper layer forefoot section 26 does not shift to the lateral side along with the hindfoot section, but rather it remains offset to the medial side of lower layer 30, substantially as shown in FIG. 5. Thus upper layer 20 rotates in the horizontal plane to the slightly toe-inward condition depicted in FIG. 3B.

Figure 2:
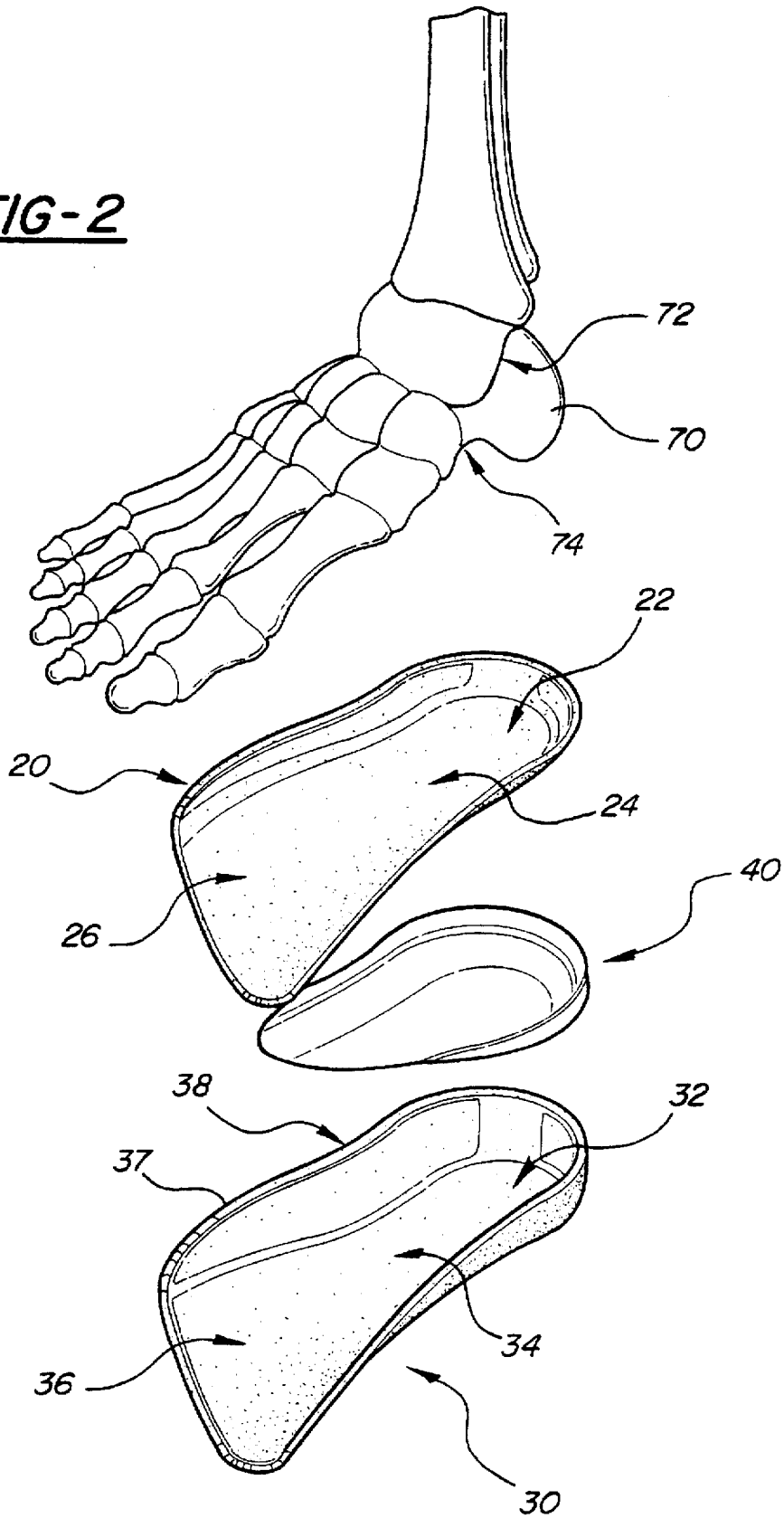
FIG. 2 is an exploded perspective view of the upper, lower, and intermediate layers of the invention sole, with a skeletal foot above the upper sole.
Figure 4:
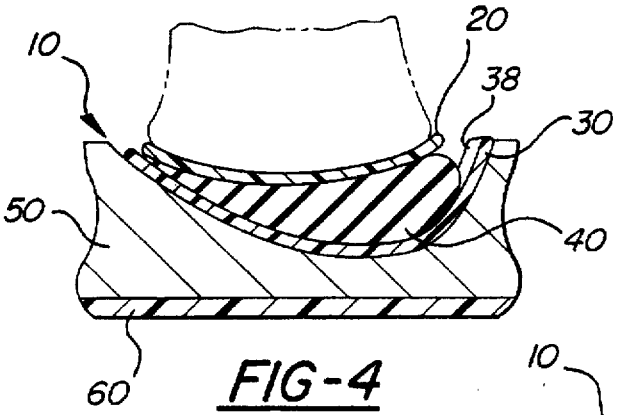
FIG. 4 is a cross-sectional view of the sole of FIG. 1 taken along line 4—4 of FIG. 3A.

It is believed that the optimum location for fulcrum 38 is at a position approximately coincident with the calcaneal-cuboid joint, indicated at 74 in FIG. 2.

The lateral motion of upper layer 20 relative to lower layer 30 as weight is applied results in a shear deformation of intermediate layer 40. This deformation of the intermediate layer serves to absorb some of the impact energy of the initial foot strike, and thus augments the energy absorbing effects of the lateral heel motion and the vertical compression of intermediate layer 40.

Figure 8:
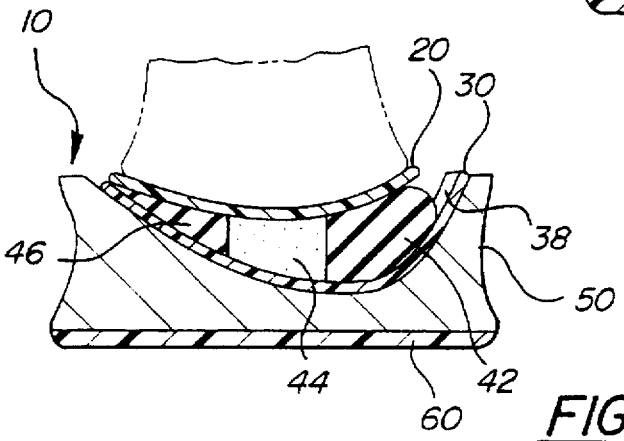
FIG. 8 is a cross-sectional view of an first alternative embodiment of the invention sole taken along line 4—4 of FIG. 3A.

As a means to promote lateral movement of upper layer 20 when downward force is applied thereto, intermediate layer 40 may be constructed so as to have a density which varies across its width, with the medial side being in general more dense than the lateral side. This can be accomplished either by forming intermediate layer 40 as a single piece of material having a continuously or discretely varying density, or by producing the intermediate layer in two or more discrete pieces which lay alongside each other as shown in FIG. 8, wherein a lower density segment 42 is positioned on the lateral side of sole, a higher density segment 44 is positioned in the center of the sole, and a highest density segment 46 is positioned on the medial side of the sole.

As the running stride progresses, the runner's body weight shifts forward onto the midfoot region of sole 10 and then onto the forefoot region. This weight shift results in a downward force being applied to upper layer forefoot section 26, and the downward and lateral slope of lower layer forefoot section 36 causes upper layer forefoot section 26 to shift toward the lateral side of the lower layer. As upper layer forefoot section 26 moves laterally, the entirety of upper layer 20 is forced to pivot in a substantially horizontal plane about its point of contact with fulcrum 38 so that the now unweighted hindfoot section 22 moves toward the medial side and upward, returning to its original, unweighted position. This toe-outward rotation of upper layer 20 with respect to lower layer 30 is best seen by comparing FIG. 3B and its comparable cross-sectional views with FIG. 3C and its comparable cross-sectional views. The resulting toe-outward rotation of the runner's foot causes the upper end of the tibia to rotate slightly outward, and this rotation tends to stabilize the knee by inducing the screw home function earlier in the running stride than would otherwise be the case.

After the shoe wearer has stepped off of the subject shoe so that all weight is removed from sole 10, the resiliency of intermediate layer 40 causes upper and lower layers 20, 30 to return to their relative positions depicted in FIG. 3A.

Figure 9:
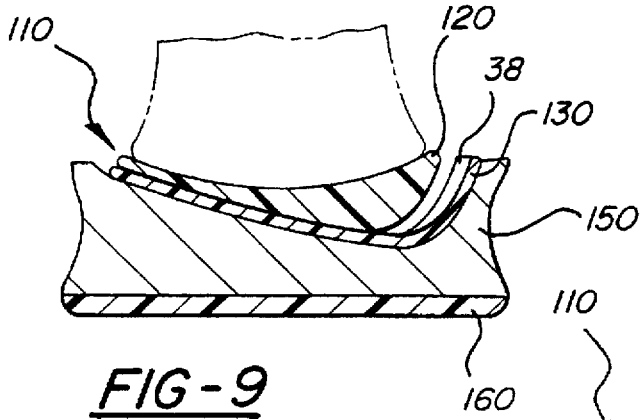
FIG. 9 is a cross-sectional view of an second alternative embodiment of the invention sole taken along line 4—4 of FIG. 3A.
Figure 10:
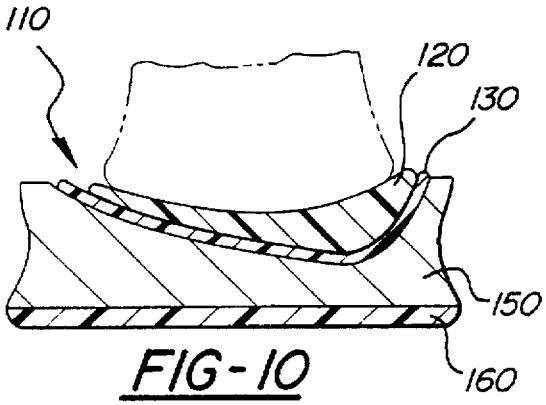
FIG. 10 is a cross-sectional view of the second alternative embodiment of the invention sole taken along line 6—6 of FIG. 3B.

An alternative embodiment of the invention is shown in FIGS. 9 and 10, which are taken along lines 4—4 of FIG. 3A and lines 6—6 of FIG. 3B respectively. A sole 110 is comprised of lower, support, and base layers, 130, 150, 160 respectively, of substantially the same construction as in the previously described embodiment, and an upper layer 120 which varies from the previously described embodiment by having a hindfoot section that is thicker along its lateral side than along its medial side. The bottom surface is thus inclined downward and laterally and is slightly convex to generally match the contours of the upper surface of lower layer 130. This configuration is in lieu of the provision of an intermediate layer as in the first described embodiment, and acts to maintain the upper layer hindfoot section in an approximately horizontal orientation while it undergoes its lateral shift. In this alternative embodiment of the invention, the forefoot section of upper layer 120 has the same cross sectional shape as upper layer 20 as shown in FIGS. 5, 12 and 7, and these figures may be used to describe the movement of the forefoot section of sole 110 by substituting reference numerals 120 and 130 for 20 and 30 respectively.

A layer of a deformable or elastic material may be interposed between all or portions or upper layer 120 and lower layer 130 to provide cushioning and/or to somewhat restrain the layers in the relative positions shown in FIGS. 3A and 9.

The relative motions of upper layer 120 and lower layer 130 is essentially the same as those of layers 20, 30 in the first described embodiment and FIGS. 3A, 3B and 3C may be referred to in conjunction with this embodiment by substituting reference numerals 120 and 130 for 20 and 30 respectively. In the unweighted condition of sole 110 shown in FIG. 9 and by corollary in FIG. 3A upper layer 120 is positioned toward the medial side relative to lower layer 130. When heel strike occurs and downward force is applied to the hindfoot region of sole 110, the hindfoot section of upper layer 120 slides downward and laterally in relation to lower layer 130, assuming the position shown in FIG. 10 and by corollary in FIG. 3B. This lateral movement of the hindfoot section of upper layer 120 carries the runner's heel with it and so simulates or enhances the proper functioning of the wearer's subtalar joint. Physical interference between fulcrum 38 and the midfoot section of upper layer 120, as seen by corollary in FIG. 3B, restrains the forefoot region of upper layer 120 against movement in the lateral direction so that a slight toe-inward rotation occurs.

Figure 7:
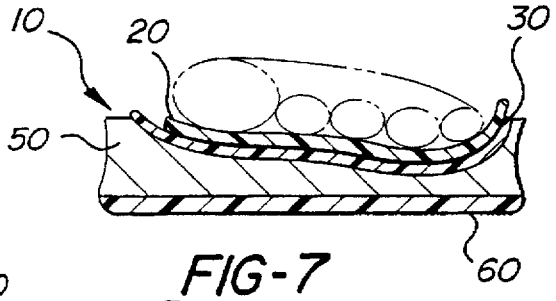
FIG. 7 is a cross-sectional view of the sole of FIG. 1 taken along line 7—7 of FIG. 3C.
Figure 12:
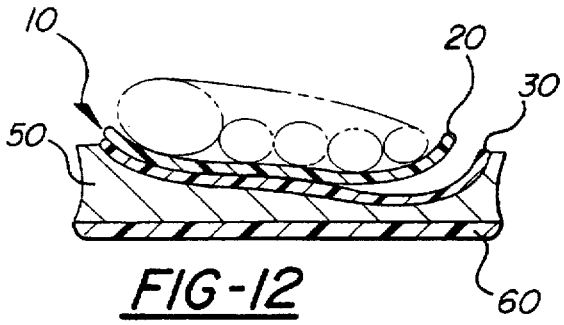
FIG. 12 is a cross-sectional view of the sole of FIG. 1 taken along line 12—12 of FIG. 3B.
Figure 13:
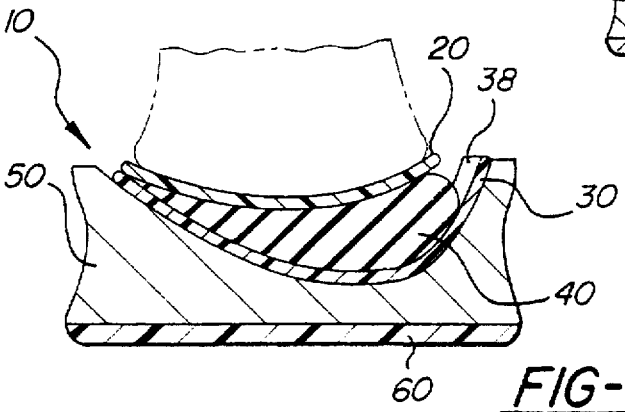
FIG. 13 is a cross-sectional view of the sole of FIG. 1 taken along line 13—13 of FIG. 3C.

As the runner's body weight shifts forward onto the forefoot region of sole 110, the downward and lateral slope of the lower layer forefoot section causes the upper layer forefoot section to shift in a lateral direction with respect to the lower layer as seen by comparing FIG. 12 with FIG.7, and upper layer 120 is forced to pivot about fulcrum 38, as seen by comparing FIG. 3B with FIG. 3C, so that the now unweighted hindfoot section of upper layer 120 moves toward the medial side and upward, returning to its original, unweighted position.

The invention sole thus provide a means for inducing and/or enhancing desirable physiological motion of a runner's subtalar joint by permitting a lateral shift of the heel bone at the time the heel strikes the running surface. The invention sole also enhances the screw home function of the knee by causing a slight toe-outward rotation of the foot, thereby increasing knee stability and injury resistance. The provision or an elastically deformable intermediate layer between the upper and lower layers provides cushioning both by compressing in a vertical direction and by absorbing energy as it is subjected to shear as the upper layer moves laterally.

It will be appreciated that the drawings and descriptions contained herein are merely meant to illustrate particular embodiments of the present invention and are not meant to be limitations upon the practice thereof, as numerous variations will occur to persons of skill in the art. For example, although the invention is described above in relation to a sole that is integrated into the construction of a shoe, it is to be understood that the invention may also be practiced in relation to a sole in the form of an orthotic device for insertion into a shoe having a conventional sole. The invention could also be practiced in relation to a sole wherein the relatively movable layers extend across only a portion of the width of the sole.

I claim:

1. An insole for a shoe comprising a lower layer and an upper layer disposed above the lower layer, each of the layers being substantially rigid and having a medial side, a lateral side, a forefoot section, a midfoot section and a hindfoot section, the upper layer being movable laterally and medially with respect to the lower layer, and the lower layer hindfoot section having an upper surface inclined downwardly and toward one of the sides of the lower layer over a substantial portion thereof, said one of the sides being designated a downslope side, whereby application of a downward force to the hindfoot section of the upper layer causes movement thereof of downward and toward the downslope side of the lower layer.

2. An insole according to claim 1 further including a fulcrum disposed adjacent the downslope side of the lower layer at the midfoot section thereof to be placed in physical interference with the upper layer midfoot section when the upper layer hindfoot section has moved downward and toward the downslope side of the lower layer, and the upper surface of the lower layer forefoot section is inclined downwardly and toward the downslope side of the lower layer over a substantial portion thereof, whereby application of a downward force to the upper layer forefoot section when the fulcrum is in physical interference with the upper layer midfoot section causes a rotating movement of the upper layer about the fulcrum, the upper layer forefoot section moving downward and toward the downslope side of the lower layer and the upper layer hindfoot section moving upward and away from the downslope side of the lower layer.

3. An insole according to claim 2 wherein the fulcrum is located at a position substantially coincident with a calcaneal-cuboid joint of a foot wearing the shoe.

4. An insole according to claim 1 further comprising an intermediate layer of a substantially resilient material disposed between the upper layer and the lower layer, the intermediate layer being in an undeformed condition when no downward force is applied to the insole and movable to a deformed condition by the movement of the hindfoot section of the upper layer downward and to the downslope side.

5. An insole sole according to claim 4 wherein the intermediate layer is of a non-uniform density across the width of the sole.

6. An insole according to claim 5 wherein the intermediate layer is generally more dense toward the downslope side of the lower layer.

7. An insole according to claim 1 wherein the upper layer has a lower surface inclined downwardly and toward the downslope side over a substantial portion of its hindfoot section.

8. A shoe sole according to claim 7 further comprising an intermediate layer of a substantially resilient material disposed between the upper layer and the lower layer.

9. An insole for a shoe comprising:

a lower layer and an upper layer each having a forefoot section, a midfoot section, a hindfoot section, a lateral side, and a medial side, the upper layer being disposed above the lower layer and movable laterally and medially relative to the lower layer; and pivot means located adjacent the midfoot section of the lower layer and adjacent one of the sides of the lower layer the pivot means defining a substantially vertically oriented pivot axis and enabling a rotating motion of the upper layer relative to the lower layer about the pivot axis.

10. An insole according to claim 9 wherein the pivot means is located at a position substantially coincident with a calcaneal-cuboid joint of a foot wearing the shoe.

11. An insole according to claim 9 further comprising an intermediate layer of a substantially resilient material disposed between the upper layer and the lower layer.

12. An insole according to claim 9 wherein the lower layer hindfoot section has an upper surface inclined downwardly and toward the lateral side over a substantial portion thereof, whereby application of a downward force to the hindfoot section of the upper layer causes movement of the hindfoot section of the upper layer in a downward and lateral direction relative to the lower layer, the lateral movement placing the lateral side of the upper layer midfoot section in a pivotable relationship with the fulcrum.

13. An insole according to claim 12 wherein the upper surface of the lower layer forefoot section is inclined downwardly and toward the lateral side over a substantial portion thereof, whereby application of a downward force to the forefoot section of the upper layer causes a downward and lateral movement of the forefoot section of the upper layer relative to the lower layer, the downward and lateral movement of the forefoot section causing the upper layer to rotate about the fulcrum such that the hindfoot section of the upper layer moves upward and medially with respect to the lower layer.

14. An insole for a shoe, the sole comprising a lower layer and an upper layer disposed above the lower layer, each of the layers having a medial side, a lateral side, a forefoot section, a midfoot section and a hindfoot section, the lower layer having an upper surface inclined downwardly and toward the lateral side over substantial portions of its forefoot and hindfoot sections, and the lower layer further including a fulcrum at the lateral side of the midfoot section, whereby application of a downward force to the hindfoot section of the upper layer causes movement of the hindfoot section of the upper layer in a downward and lateral direction relative to the lower layer to place the upper and lower layers in interfering relationship with one another at the fulcrum, and whereby subsequent application of a downward force to the forefoot section of the upper layer causes a downward and lateral movement of the forefoot section of the upper layer relative to the lower layer, the downward and lateral movement of the forefoot section causing the upper layer to rotate in a substantially horizontal plane about the fulcrum such that the hindfoot portion of the upper layer moves upward and medially with respect to the lower layer.

15. An insole according to claim 14 further comprising an intermediate layer of a substantially resilient material disposed between at least a portion of the upper layer and at least a portion of the lower layer, the intermediate layer being in an undeformed condition when no downward force is applied to the shoe sole and movable to a deformed condition by the downward and lateral movement of the hindfoot section of the upper layer.

16. An insole according to claim 15 wherein the intermediate layer is of a non-uniform density over the width of the sole.

17. An insole according to claim 16 wherein the intermediate layer is generally more dense toward its medial side than toward its lateral side.

18. An insole according to claim 14 wherein the upper layer has a lower surface inclined downwardly and toward the lateral side over a substantial portion of its hindfoot and forefoot sections.

19. An insole according to claim 1 wherein the downslope side of the lower layer is the lateral side thereof.

20. An insole according to claim 2 wherein the downslope side of the lower layer is the lateral side thereof.

21. An insole according to claim 9 wherein the pivot means comprises a fulcrum formed integrally with the lower layer at one of the sides thereof and projecting toward the opposite side of the lower layer.

22. An insole according to claim 9 wherein the fulcrum is disposed on the lateral side of the lower layer and projects toward the medial side of the lower layer.

23. An insole according to claim 9 wherein the upper and lower layers are substantially rigid.

* * * * *